US008904672B1

(12) United States Patent
Johnson

(10) Patent No.: US 8,904,672 B1
(45) Date of Patent: Dec. 9, 2014

(54) AUTOMATED TIGHTENING SHOE

(75) Inventor: Gregory G Johnson, Hugo, MN (US)

(73) Assignee: Palidium Inc., Hugo, MN (US)

( * ) Notice: Subject to any disclaimer, the term of this patent is extended or adjusted under 35 U.S.C. 154(b) by 412 days.

(21) Appl. No.: 13/199,078

(22) Filed: Aug. 18, 2011

(51) Int. Cl.

| | |
|---|---|
| ***A43C 11/00*** | (2006.01) |
| ***A43B 5/04*** | (2006.01) |
| ***A43B 11/00*** | (2006.01) |
| ***A43B 23/28*** | (2006.01) |

(52) U.S. Cl.
USPC ..... 36/50.1; 36/50.5; 36/138; 36/58.6; 36/58.5

(58) Field of Classification Search
CPC ..... A43B 11/00; A43B 11/02; A43C 11/144; A43C 11/165; A43C 11/1406; A43C 11/1442; A43C 11/1433; A43C 11/20
USPC ..... 36/50.1, 50.5, 138, 58.5, 58.6
See application file for complete search history.

(56) References Cited

U.S. PATENT DOCUMENTS

| | | | | |
|---|---|---|---|---|
| 737,769 | A | | 9/1903 | Preston |
| 2,124,310 | A | | 9/1936 | Murr, Jr. |
| 3,793,749 | A | | 2/1974 | Gertsch et al. |
| 4,408,403 | A | | 10/1983 | Martin |
| 4,426,796 | A | | 1/1984 | Spademan |
| 4,653,204 | A | | 3/1987 | Morell et al. |
| 4,660,300 | A | | 4/1987 | Morell et al. |
| 4,748,726 | A | | 6/1988 | Schoch |
| 4,787,124 | A | | 11/1988 | Pozzobon et al. |
| 4,937,952 | A | | 7/1990 | Olivieri |
| 4,937,953 | A | | 7/1990 | Walkhoff |
| 5,152,038 | A | | 10/1992 | Schoch |
| 5,157,813 | A | * | 10/1992 | Carroll ..... 24/68 SK |
| 5,158,559 | A | * | 10/1992 | Pozzobon et al. ..... 36/118.1 |
| 5,167,083 | A | * | 12/1992 | Walkhoff ..... 36/118.9 |
| 5,175,949 | A | | 1/1993 | Seidel |
| 5,205,055 | A | * | 4/1993 | Harrell ..... 36/50.1 |
| 5,230,171 | A | | 7/1993 | Cardaropoli |
| 5,291,671 | A | | 3/1994 | Caberlotto et al. |
| 5,325,613 | A | * | 7/1994 | Sussmann ..... 36/50.1 |
| 5,327,662 | A | | 7/1994 | Hallenbeck |
| 5,335,401 | A | * | 8/1994 | Hanson ..... 24/712.5 |
| 5,341,583 | A | | 8/1994 | Hallenbeck |
| 5,379,532 | A | | 1/1995 | Seidel |
| 5,381,609 | A | | 1/1995 | Hieblinger |
| 5,606,778 | A | | 3/1997 | Jungkind |
| 5,839,210 | A | | 11/1998 | Bernier et al. |
| 5,934,599 | A | * | 8/1999 | Hammerslag ..... 242/396.1 |
| 5,983,530 | A | * | 11/1999 | Chou ..... 36/50.1 |
| 5,996,256 | A | * | 12/1999 | Zebe, Jr. ..... 36/50.1 |
| 6,032,387 | A | * | 3/2000 | Johnson ..... 36/50.1 |
| 6,267,390 | B1 | * | 7/2001 | Maravetz et al. ..... 280/14.21 |
| 6,289,558 | B1 | | 9/2001 | Hammerslag |
| 6,324,774 | B1 | | 12/2001 | Zebe, Jr. |
| 6,378,230 | B1 | | 4/2002 | Rotem et al. |
| 6,427,361 | B1 | | 8/2002 | Chou |

(Continued)

*Primary Examiner* — Khoa Huynh
*Assistant Examiner* — Timothy K Trieu
(74) *Attorney, Agent, or Firm* — Moss & Barnett

(57) ABSTRACT

An automated tightening shoe with a single crisscrossed laces or closure panel and a tightening mechanism which operates in one direction to cause automatic tightening of the crisscrossed laces or closure panel to tighten the shoe about a wearer's foot, and which can be released easily so that the shoe can be removed from the wearer's foot. An actuating wheel partially projecting from the rear sole of the shoe provides a convenient and reliable actuating means for movement of the automated tightening mechanism in the tightening direction.

24 Claims, 11 Drawing Sheets

(56) References Cited

U.S. PATENT DOCUMENTS

| | | | | |
|---|---|---|---|---|
| 6,467,194 | B1 * | 10/2002 | Johnson | 36/50.1 |
| 6,560,898 | B2 | 5/2003 | Borsoi et al. | |
| 6,643,954 | B2 | 11/2003 | Voswinkel | |
| 6,671,980 | B1 * | 1/2004 | Liu | 36/50.1 |
| 6,745,643 | B2 * | 6/2004 | Lubanski | 74/594.6 |
| 6,807,754 | B2 * | 10/2004 | Miller et al. | 36/97 |
| 6,877,256 | B2 * | 4/2005 | Martin et al. | 36/50.5 |
| 6,883,225 | B2 | 4/2005 | Fowler | |
| 6,896,128 | B1 * | 5/2005 | Johnson | 36/50.1 |
| 6,922,917 | B2 * | 8/2005 | Kerns et al. | 36/50.1 |
| 6,926,289 | B2 | 8/2005 | Wang | |
| 7,065,906 | B2 * | 6/2006 | Jones et al. | 36/50.1 |
| 7,076,843 | B2 * | 7/2006 | Sakabayashi | 24/68 SK |
| 7,096,559 | B2 * | 8/2006 | Johnson | 29/433 |
| 7,103,994 | B2 * | 9/2006 | Johnson | 36/50.1 |
| 7,195,251 | B2 | 3/2007 | Walker | |
| 7,287,304 | B2 * | 10/2007 | Zebe, Jr. | 24/134 P |
| 7,331,126 | B2 * | 2/2008 | Johnson | 36/50.1 |
| 7,540,101 | B2 * | 6/2009 | Harrington | 36/131 |
| 7,661,205 | B2 * | 2/2010 | Johnson | 36/50.1 |
| 7,669,880 | B2 * | 3/2010 | Doyle et al. | 280/611 |
| 7,676,957 | B2 * | 3/2010 | Johnson | 36/50.1 |
| 7,721,468 | B1 * | 5/2010 | Johnson et al. | 36/50.1 |
| 7,954,204 | B2 * | 6/2011 | Hammerslag et al. | 24/68 SK |
| 8,032,993 | B2 * | 10/2011 | Musal | 24/68 B |
| 8,087,188 | B2 * | 1/2012 | Labbe | 36/50.1 |
| 8,091,182 | B2 * | 1/2012 | Hammerslag et al. | 24/68 SK |
| 8,181,320 | B2 * | 5/2012 | Wolfberg | 24/712.5 |
| 8,196,322 | B2 * | 6/2012 | Atsumi et al. | 36/133 |
| 8,201,346 | B2 * | 6/2012 | Darby et al. | 36/7 R |
| 8,434,200 | B2 * | 5/2013 | Chen | 24/68 SK |
| 8,468,657 | B2 * | 6/2013 | Soderberg et al. | 24/68 SK |
| 8,516,662 | B2 * | 8/2013 | Goodman et al. | 24/68 SK |
| 2002/0095750 | A1 * | 7/2002 | Hammerslag | 24/68 SK |
| 2002/0174568 | A1 * | 11/2002 | Neiley | 36/50.1 |
| 2003/0024135 | A1 * | 2/2003 | Liu | 36/50.1 |
| 2003/0177661 | A1 | 9/2003 | Tsai | |
| 2005/0198866 | A1 * | 9/2005 | Wiper et al. | 36/50.1 |
| 2005/0210706 | A1 * | 9/2005 | Johnson | 36/50.1 |
| 2006/0117607 | A1 * | 6/2006 | Pare et al. | 36/50.1 |
| 2006/0191164 | A1 | 8/2006 | Dinndorf et al. | |
| 2006/0201031 | A1 * | 9/2006 | Jones et al. | 36/50.1 |
| 2007/0011914 | A1 * | 1/2007 | Keen et al. | 36/50.1 |
| 2007/0240334 | A1 * | 10/2007 | Johnson | 36/50.1 |
| 2013/0086816 | A1 * | 4/2013 | Johnson et al. | 36/83 |

* cited by examiner

AUTOMATED TIGHTENING SHOE

FIELD OF THE INVENTION

The present invention pertains to a shoe and, more particularly, to an automated tightening shoe. The shoe is provided with an automated tightening system, including a tightening mechanism which operates in one direction to cause automatic tightening of the shoe about a wearer's foot, and which can be released easily so that the shoe can be readily removed from the wearer's foot. The invention is chiefly concerned with an automated tightening shoe of the sport or athletic shoe variety, but the principles of the invention are applicable to shoes of many other types and styles.

BACKGROUND OF THE INVENTION

Footwear, including shoes and boots, are an important article of apparel. They protect the foot and provide necessary support, while the wearer stands, walks, or runs. They also can provide an aesthetic component to the wearer's personality.

A shoe comprises a sole constituting an outsole and heel, which contact the ground. Attached to a shoe that does not constitute a sandal or flip flop is an upper that acts to surround the foot, often in conjunction with a tongue. Finally, a closure mechanism draws the medial and lateral portions of the upper snugly around the tongue and wearer's foot to secure the shoe to the foot.

The most common form of a closure mechanism is a lace criss-crossing between the medial and lateral portions of the shoe upper that is pulled tightly around the instep of the foot, and tied in a knot by the wearer. While simple and practical in functionality, such shoe laces need to be tied and retied throughout the day as the knot naturally loosens around the wearer's foot. This can be a hassle for the ordinary wearer. Moreover, young children may not know how to tie a knot in the shoe lace, thereby requiring assistance from an attentive parent or caregiver. Furthermore, elderly people suffering from arthritis may find it painful or unduly challenging to pull shoe laces tight and tie knots in order to secure shoes to their feet.

The shoe industry over the years has adopted additional features for securing a tied shoe lace, or alternative means for securing a shoe about the wearer's foot. Thus, U.S. Pat. No. 737,769 issued Preston in 1903 added a closure flap across the shoe instep secured to the upper by an eyelet and stud combination. U.S. Pat. No. 5,230,171 issued to Cardaropoli employed a hook and eye combination to secure the closure flap to the shoe upper. A military hunting boot covered by U.S. Pat. No. 2,124,310 issued to Murr, Jr. used a lace zigzagging around a plurality of hooks on the medial and lateral uppers and finally secured by means of a pinch fastener, thereby dispensing with the need for a tied knot. See also U.S. Pat. No. 6,324,774 issued to Zebe, Jr.; and U.S. Pat. No. 5,291,671 issued to Caberlotto et al.; and U.S. Application 2006/0191164 published by Dinndorf et al. Other shoe manufactures have resorted to small clamp or pinch lock mechanisms that secure the lace in place on the shoe to retard the pressure applied throughout the day by the foot within the shoe that pulls a shoe lace knot apart. See, e.g., U.S. Pat. No. 5,335,401 issued to Hanson; U.S. Pat. No. 6,560,898 issued to Borsoi et al.; and U.S. Pat. No. 6,671,980 issued to Liu.

Other manufactures have dispensed entirely with the shoe lace. For example, ski boots frequently use buckles to secure the boot uppers around the foot and leg. See, e.g., U.S. Pat. No. 3,793,749 issued to Gertsch et al., and U.S. Pat. No. 6,883,255 issued to Morrow et al. Meanwhile, U.S. Pat. No. 5,175,949 issued to Seidel discloses a ski boot having a yoke extending from one part of the upper that snap locks over an upwardly protruding "nose" located on another portion of the upper with a spindle drive for adjusting the tension of the resulting lock mechanism. Because of the need to avoid frozen or ice-bound shoe laces, it is logical to eliminate external shoe laces from ski boots, and substitute an external locking mechanism that engages the rigid ski boot uppers.

A different approach employed for ski boots has been the use of internally routed cable systems tightened by a rotary ratchet and pawl mechanism that tightens the cable, and therefore the ski boot, around the wearer's foot. See, e.g., U.S. Pat. Nos. 4,660,300 and 4,653,204 issued to Morell et al.; U.S. Pat. No. 4,748,726 issued to Schoch; U.S. Pat. No. 4,937,953 issued to Walkhoff; and U.S. Pat. No. 4,426,796 issued to Spademan. U.S. Pat. No. 6,289,558 issued to Hammerslang extended such a rotary ratchet-and-pawl tightening mechanism to an instep strap of an ice skate. Such a rotary ratchet-and-pawl tightening mechanism and internal cable combination have also been applied to athletic and leisure shoes. See, e.g., U.S. Pat. No. 5,157,813 issued to Carroll; U.S. Pat. Nos. 5,327,662 and 5,341,583 issued to Hallenbeck; and U.S. Pat. No. 5,325,613 issued to Sussmann.

U.S. Pat. No. 4,787,124 issued to Pozzobon et al.; U.S. Pat. No. 5,152,038 issued to Schoch; U.S. Pat. No. 5,606,778 issued to Jungkind; and U.S. Pat. No. 7,076,843 issued to Sakabayashi disclose other embodiments of rotary tightening mechanisms based upon ratchet-and-pawl or drive gear combinations operated by hand or a pull string. These mechanisms are complicated in their number of parts needed to operate in unison.

Still other mechanisms are available on shoes or ski boots for tightening an internally or externally routed cable. A pivotable lever located along the rear upper operated by hand is taught by U.S. Pat. No. 4,937,952 issued to Olivieri; U.S. Pat. No. 5,167,083 issued to Walkhoff; U.S. Pat. No. 5,379,532 issued to Seidel; and U.S. Pat. No. 7,065,906 issued to Jones et al. A slide mechanism operated by hand positioned along the rear shoe upper is disclosed by U.S. Application 2003/0177661 filed by Tsai for applying tension to externally routed shoelaces. See also U.S. Pat. No. 4,408,403 issued to Martin, and U.S. Pat. No. 5,381,609 issued to Hieblinger.

Other shoe manufacturers have designed shoes containing a tightening mechanism that can be activated by the wearer's foot instead of his hand. For example, U.S. Pat. No. 6,643,954 issued to Voswinkel discloses a tension lever located inside the shoe that is pressed down by the foot to tighten a strap across the shoe upper. Internally routed shoe lace cables are actuated by a similar mechanism in U.S. Pat. Nos. 5,983,530 and 6,427,361 issued to Chou; and U.S. Pat. No. 6,378,230 issued to Rotem et al. However, such tension lever or push plate may not have constant pressure applied to it by the foot, which will result in loosening of the tightening cable or strap. Moreover, the wearer may find it uncomfortable to step on the tension lever or push plate throughout the day. U.S. Pat. No. 5,839,210 issued to Bernier et al. takes a different approach by using a battery-charged retractor mechanism with an associated electrical motor positioned on the exterior of the shoe for pulling several straps across the shoe instep. But, such a battery-operated device can suffer from short circuits, or subject the wearer to a shock in a wet environment.

The shoe industry has also produced shoes for children and adults containing Velcro® straps in lieu of shoelaces. Such straps extending from the medial upper are readily fastened to a complementary Velcro patch secured to the lateral upper. But, such Velcro closures can frequently become disconnected when too much stress is applied by the foot. This particularly occurs for athletic shoes and hiking boots. Moreover, Velcro closures can become worn relatively quickly, losing their capacity to close securely. Furthermore, many wearers find Velcro straps to be aesthetically ugly on footwear.

Gregory G. Johnson, the present inventor, has developed a number of shoe products containing automated tightening mechanisms located within a compartment in the sole or along the exterior of the shoe for tightening interior or exterior cables positioned inside or outside the shoe uppers, while preventing unwanted loosening of the cables. Such tightening mechanism can entail a pair of gripping cams that engage the tightened cable, a track-and-slide mechanism that operates like a ratchet and pawl to allow movement in the tightening direction, while preventing slippage in the loosening direction, or an axle assembly for winding the shoe lace cable that also bears a ratchet wheel engaged by a pawl on a release lever for preventing counter-rotation. Johnson's automated tightening mechanisms can be operated by a hand pull string or track-and-slide mechanism, or an actuating lever or push plate extending from the rear of the shoe sole that is pressed against the ground or floor by the wearer to tighten the shoe lace cable. An associated release lever may be pressed by the wearer's hand or foot to disengage the automated tightening mechanism from its fixed position to allow loosening of the shoe lace or cables for taking off the shoe. See U.S. Pat. Nos. 6,032,387; 6,467,194; 6,896,128; 7,096,559; and 7,103,994 issued to Johnson.

However, none of the automated tightening systems heretofore devised has been entirely successful or satisfactory. Major shortcomings of the automated tightening systems of the prior art are that they fail to tighten the shoe from both sides so that it conforms snugly to the wearer's foot, and that they lack any provision for quickly loosening the shoe when it is desired to remove the shoe from the wearer's foot. Moreover, they frequently suffer from: (1) complexity, in that they involve numerous parts; (2) the inclusion of expensive parts, such as small electric motors; (3) the use of parts needing periodic replacement, e.g. a battery; or (4) the presence of parts requiring frequent maintenance. These aspects, as well as others not specifically mentioned, indicate that considerable improvement is needed in order to attain an automated tightening shoe that is completely successful and satisfactory.

Gregory Johnson has also developed an automated shoe tightening mechanism embedded in a shoe that is actuated by a wheel extending from the sole of the shoe. See U.S. Pat. Nos. 7,661,205 and 7,676,957. However, because the laces are physically secured to the tightening mechanism contained within a chamber of the shoe sole, they cannot be replaced should they fray or break. This shortens the useful life of the shoe product.

Therefore, it would be advantageous to provide a shoe or other footwear product containing an automated tightening mechanism that is simple in design with few operating parts that can be operated by the foot without use of the wearer's hands, such as by a roller wheel extending from the heel of the shoe sole, while permitting the shoe lace to be replaced to extend the useful life of the shoe. Shoes that can be converted into a roller skate via a roller wheel that pivots out of a storage compartment in the sole are known. See, e.g., U.S. Pat. No. 6,926,289 issued to Wang, and U.S. Pat. No. 7,195,251 issued to Walker. Such a popular shoe is sold under the brand Wheelies®. However, this type of convertible roller skating shoe does not contain an automated tightening mechanism, let alone use the roller wheel to actuate such a mechanism. The roller is used instead solely for recreational purposes.

SUMMARY OF THE INVENTION

An automated tightening shoe that tightens snugly around the wearer's foot without use of the wearer's hands, and that can also be loosened easily upon demand without use of the wearer's hands is provided by this invention. The automated tightening shoe contains a sole and an integral body member or shoe upper constructed of any suitable material. The shoe upper includes a toe, a heel, a tongue, and medial and lateral sidewall portions. A unitary lace is provided for engaging a series of eyelets in a reinforced lacing pad along the periphery of the medial and lateral uppers. This lace is pulled by the automated tightening mechanism in a crisscrossed fashion across the tongue to draw the medial and lateral shoe uppers around the wearer's foot and snugly against the tongue on top of the wearer's instep. This automated tightening mechanism assembly is preferably located within a chamber contained within the shoe sole, and comprises a rotatable axle for winding the shoe lace. A roller wheel is attached to the axle that extends partially from the rear sole of the shoe, so that the wearer can rotate the roller wheel on the ground or floor to bias the axle of the automated tightening mechanism in the tightening direction. A ratchet wheel having ratchet teeth also secured to the axle is successively engaged by a pawl at the distal end of a release lever to prevent the axle from counter-rotating. When the wearer engages the release lever preferably extending from the heel of the shoe, however, the pawl is pivoted out of engagement with the teeth of the ratchet wheel, so that the axle of the automated tightening mechanism can freely counter-rotate to release the shoe lace to its standby position, and allow the shoe lace to be loosened easily without the use of the wearer's hands. Moreover, the shoe lace should extend through the entire rotatable axle so that it can be readily replaced by threading a new lace attached thereto through the interior of the shoe uppers and into operative engagement with the rotatable axle of the automated tightening mechanism without access to the tightening mechanism positioned inside the shoe sole chamber required.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DETAILED DESCRIPTION OF THE PREFERRED EMBODIMENT

An automated tightening shoe containing a wheel-actuated tightening mechanism for tightening crisscrossed shoe lace for drawing the shoe upper around the wearer's foot is provided by the invention. Such an automated tightening mechanism assembly preferably comprises an axle for winding the shoe lace in a tightening direction, a fixed roller wheel partially projecting preferably from the rear sole of the shoe for rotating the axle in the tightening direction, and a fixed ratchet wheel with ratchet teeth for successively engaging a pawl on the end of a release lever to prevent the axle from counter-rotating. When the release lever is biased to disengage the pawl from the ratchet wheel teeth, the axle can freely counter-rotate to release the shoe lace to allow the shoe lace to loosen. This invention provides an automated tightening mechanism that has few parts, and is reliable in its operation, while allowing the shoe lace to be replaced without access to the tightening mechanism concealed within the sole of the shoe. The mechanism also can be operated in both the tightening direction and the loosening direction without use of the wearer's hands.

For purposes of the present invention, "shoe" means any closed footwear product having an upper part that helps to hold the shoe onto the foot, including but not limited to boots; work shoes; snow shoes; ski and snowboard boots; sport or athletic shoes like sneakers, tennis shoes, running shoes, golf shoes, cleats, and basketball shoes; ice skates, roller skates; in-line skates; skateboarding shoes; bowling shoes; hiking shoes or boots; dress shoes; casual shoes; walking shoes; dance shoes; and orthopedic shoes.

Although the present invention may be used in a variety of shoes, for illustrative purposes only, the invention is described herein with respect to athletic shoes. This is not meant to limit in any way the application of the automated tightening mechanism of this invention to other appropriate or desirable types of shoes.

Figure 1:
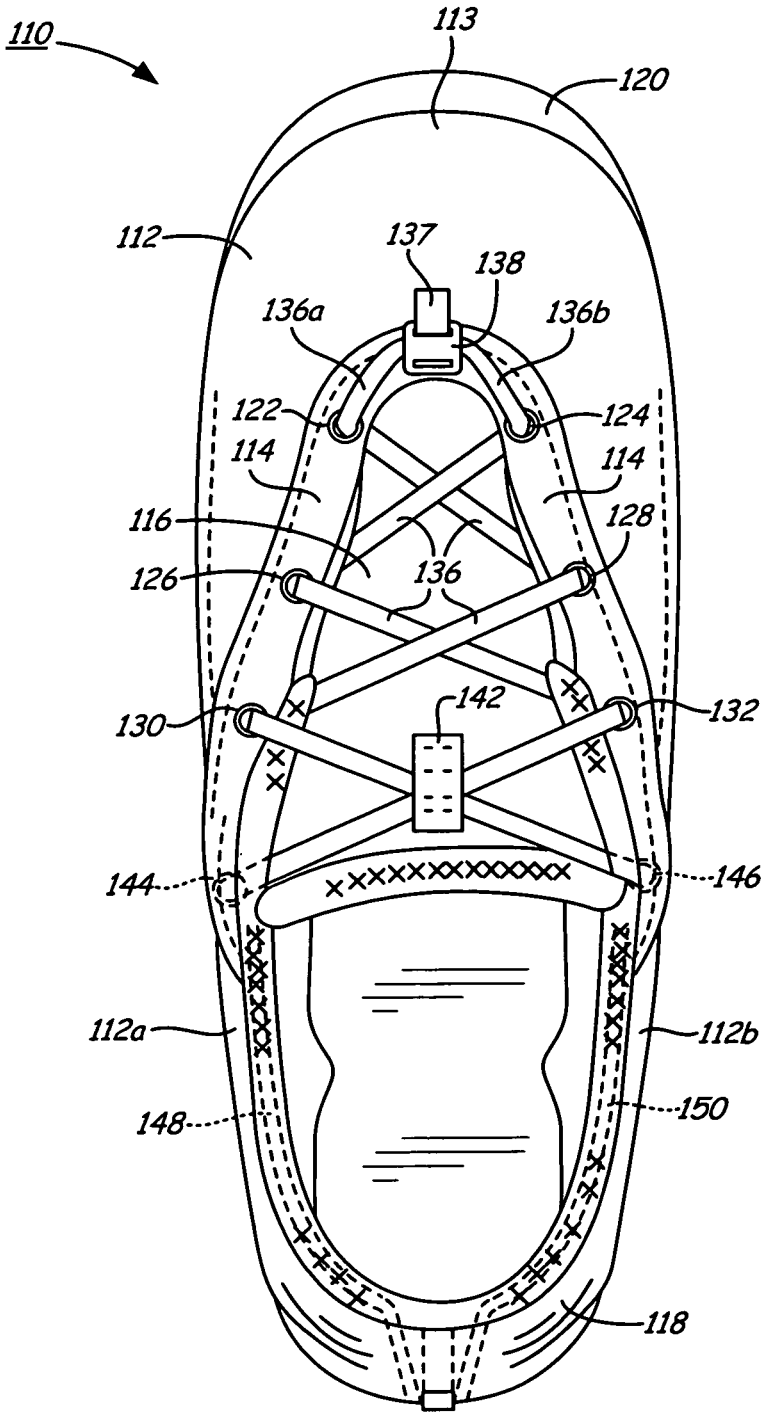
FIG. 1 illustrates a top view of an automated tightening shoe of the present invention having crisscrossed laces in the loosened condition.
Figure 2:
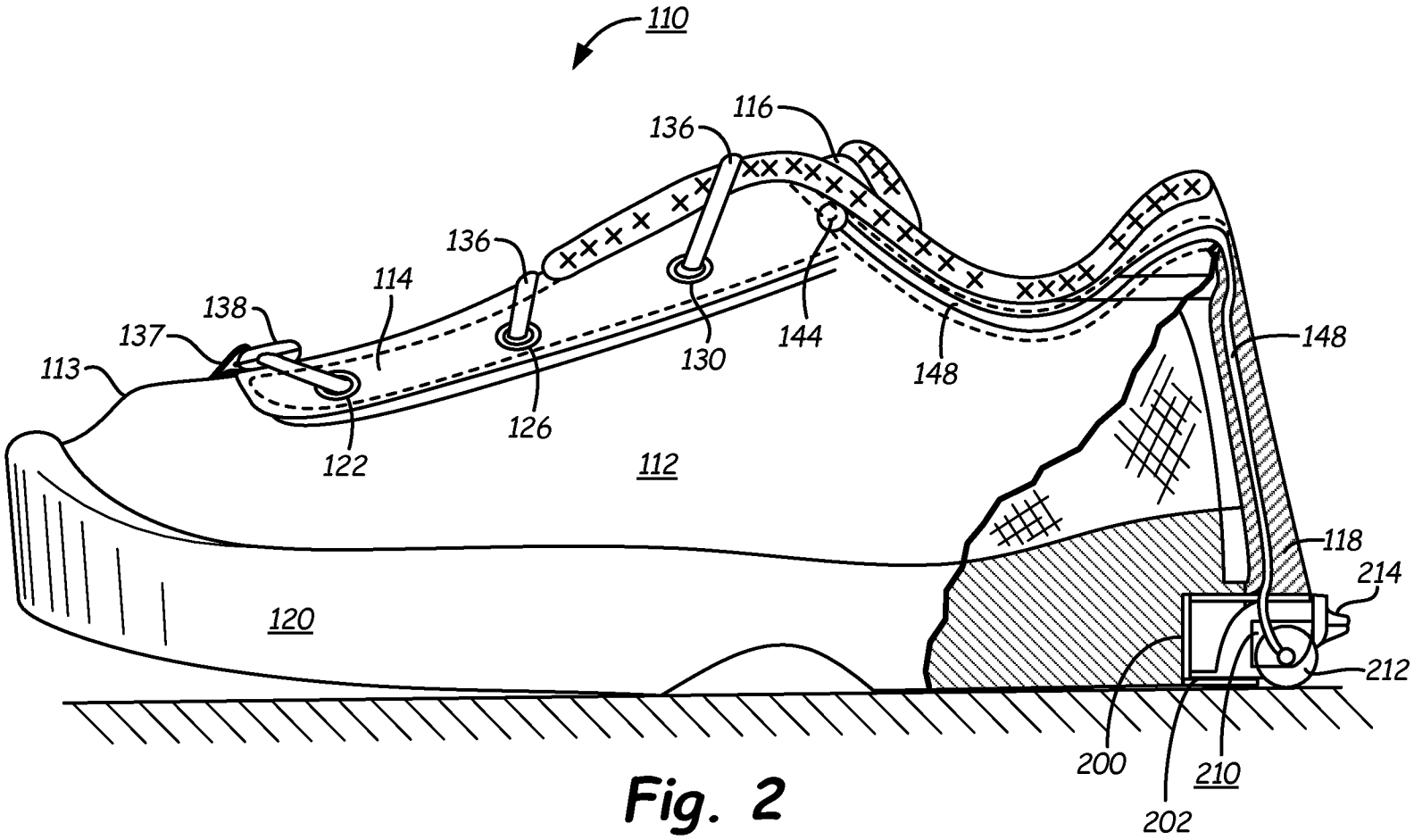
FIG. 2 illustrates a side view, in partial cutaway, of the automated tightening shoe embodiment of FIG. 2.

FIG. 1 illustrates a top view of an automated tightening shoe 110 of the present invention in the open condition, and FIG. 2 illustrates a side view, in partial cutaway, of the automated tightening shoe 110 showing the tightening mechanism. The automated tightening shoe 110 has a sole 120, an integral body member or shoe upper 112 including a tongue 116, a toe 113, a heel 118, and a reinforced lacing pad 114, all constructed of any appropriate material for the end use application of the shoe.

The automated tightening shoe 110 of the present invention includes a single shoe lace 136 configured into a continuous loop. At the toe 113 end of tongue 116, there is provided clip 138 which is secured to the lacing pad 114 or toe upper of the shoe by any appropriate means such as ribbon 137 or a rivet or other fastener. This clip 138 is then secured to lace 136 to hold it in place with respect to the stationary clip. The two distal ends 136*a* and 136*b* of lace 136 extend through eyelets 122 and 124 on lacing pad 114, so that the free lace ends are disposed above the lacing pad. This shoe lace 136 then criss-crosses over tongue 116 and passes through lace eyelets 126, 128, 130, and 132, as illustrated, before passing through lace containment loop 142. After passing through lace containment loop 142, lace 136 passes through holes 144 and 146 in the reinforced lacing pad 114 and travels rearwardly through sections of tubing 148 and 150 which pass in-between the outer and inner materials of the medial and lateral portions 112*a* and 112*b* of shoe upper 112 and down the heel of the shoe. These internal tubing sections 148 and 150 extend into chamber 200 located in the sole 120 of the automated tightening shoe 110. In this manner, the lace 136 passes through guide tubes 148 and 150, passing into operative engagement with automated tightening mechanism 210 therebetween. When the free ends 136*a* and 136*b* of shoe lace 136 are knotted together above the toe upper of the shoe, the continuous loop is produced. Clip 138 hides this knot and helps to prevent the shoe lace loop from coming apart. It should be noted that the lace 136 may alternatively be routed along the exterior of the shoe upper for purposes of this invention in order to dispense with the need for the tubing 148 and 150.

Figure 3:
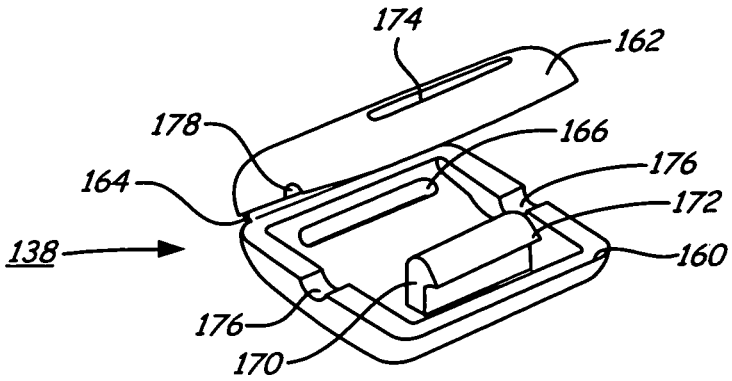
FIG. 3 illustrates the shoe lace securement clip in its opened position.
Figure 4:
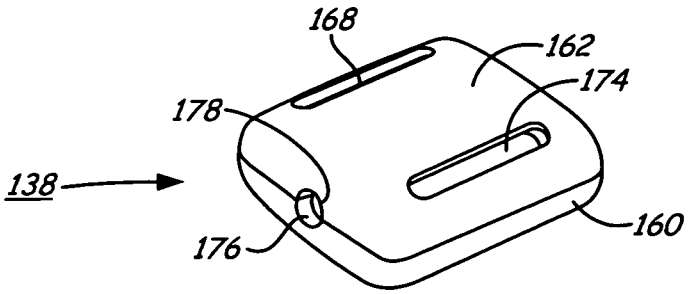
FIG. 4 illustrates the shoe lace securement clip of FIG. 3 in its closed position.

The clip 138 is shown in greater detail in FIGS. 3-4. It comprises a bottom housing 160 and a top housing 162 joined together by means of hinge 164. The top housing 162, bottom housing 160, and hinge 164 may be made from plastic, metal, or any other material that is suitably light-weight and resistant to the weather elements. One advantage of plastic is that these three portions of clip 138 may be molded together as a unitary construction.

The bottom housing 160 and top housing 162 feature cooperating slots 166 and 168, respectively. Ribbon 137 used to secure clip 138 to the upper of shoe 110 can be easily threaded through these slots. The interior or bottom housing 160 also bears upwardly projecting flange 170 with forwardly projecting lip 172. Meanwhile, top housing 162 bears second slot 174. Finally, both bottom housing 162 and top housing 160 contain cooperating niches 176 and 178 respectively dimensioned such that when the two housings of clip 138 are closed against each other, the niches combine to form a circular opening.

Clip 138 can be easily secured to lace 136 as follows: The desired position along lace 136 is placed into the opened clip assembly and into niches 176 on bottom housing 160. Top housing 162 is then pushed down against bottom housing 160 until flange 170 penetrates slot 174 and lip 172 clicks into engagement with an interior niche in top housing 162 to prevent unwanted separation of the two housing halves. Lace 136 is accommodated by niches 176 and 178 in the housings so that fastened clip assembly 138 encapsulates the lace 136. In this manner, lace 136 is secured in position to the upper of shoe 110.

Figure 5:
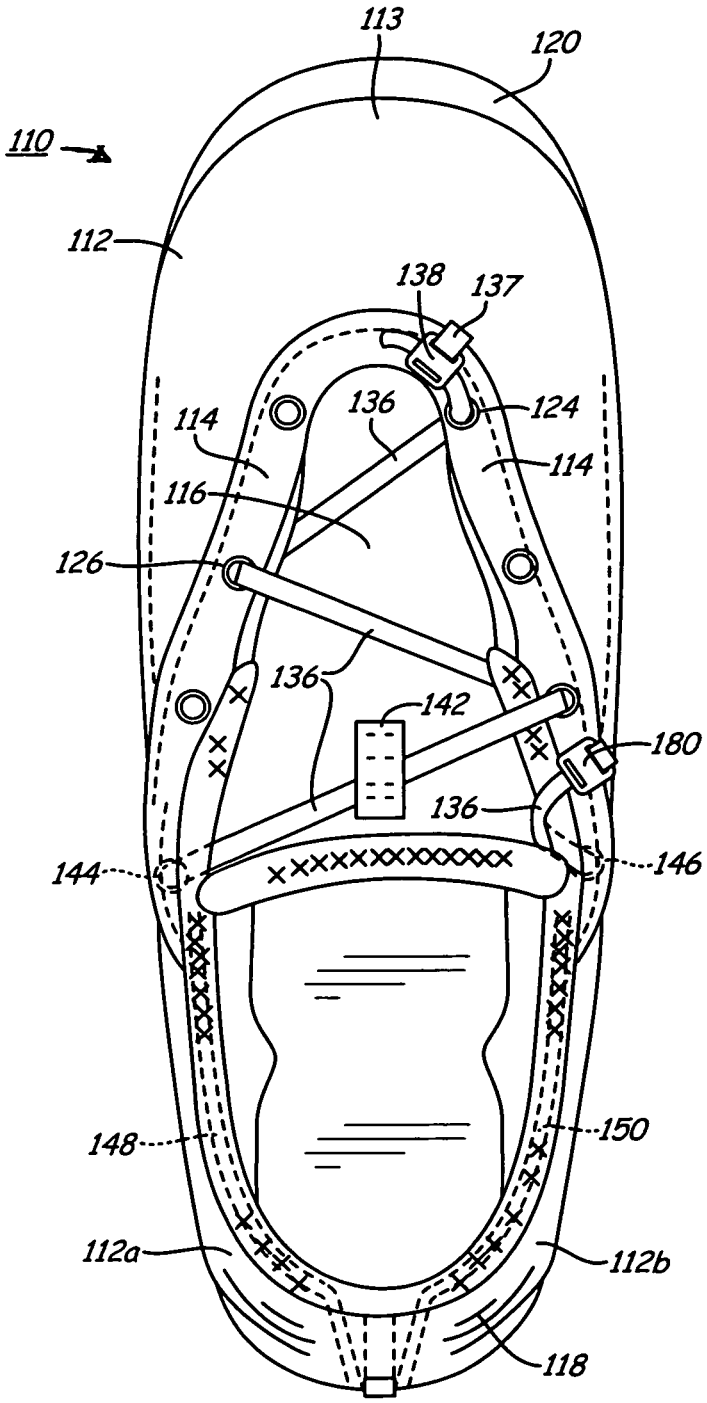
FIG. 5 illustrates a top view of any automated tightening shoe of the present invention having zig-zagged laces in the loosened condition.

While the preferred embodiment of the automated tightening shoe 110 of the present invention utilizes the crisscrossed lace arrangement shown in FIG. 1, other possible closure arrangements are possible. For example, FIG. 5 shown a zig-zag lacing pattern. In this zig-zag configuration, one free end 136*a* of lace 136 is secured to shoe toe upper 112 by means of clip 138. The clip can be secured to lacing pad 114 or to the upper adjacent to the lacing pad. Lace 136 is then threaded through eyelets 124, 126, and 132 and then through opening 144, whereupon it passes through guide tube 148 disposed within shoe upper 112*a*, then through automated tightening mechanism 210 located inside the sole of the shoe near its heel, back through guide tube 150 disposed within shoe upper 112*b*, and then back through opening 146, whereupon free end 136*b* of lace 136 is secured to the lacing pad 114 by means of clip 180.

Figure 6:
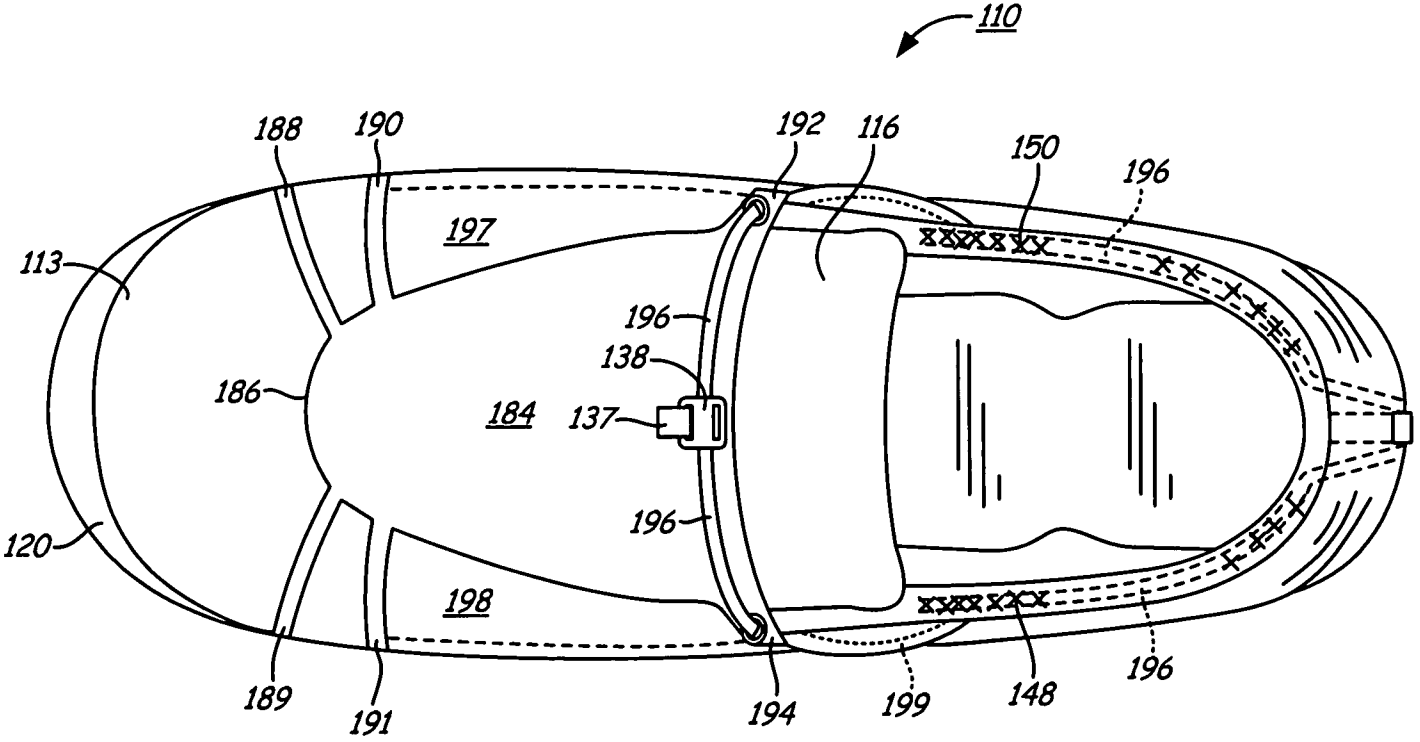
FIG. 6 illustrates a top view of any automated tightening shoe of the present invention having a closure panel for tightening the shoe in lieu of shoe laces.

Automated tightening shoe 110 may alternatively employ closure panel 184 instead of crisscrossed or zig-zag lace 136, as shown more fully in FIG. 6. Closure panel 184 is secured at its forward end 186 to shoe sole 120 by means of lower tabs 188 and 190 along the medial side, and tabs 189 and 191 along the lateral side. Closure panel 184 covers tongue 116. Meanwhile, upper tabs 192 and 194, respectively, are secured to engagement cable 196, which tightens closure panel 184 by means of the automated tightening mechanism 210 described below. Clip 138 secures engagement cable 196 to closure panel 184 in the manner described above. This engagement cable 196 is formed in the same continuous loop within the shoe for operative engagement with the automated tightening mechanism 210, as described herein for the lace 136 embodiments shown in FIGS. 1 and 5. In an alternative embodiment, closure panel 184 can be fastened along its one side to medial upper 197 and then pulled against lateral upper 198 by means of engagement cable 199.

Automated tightening mechanism 210 is located in housing chamber 200 secured to housing bottom 202, as shown more fully in FIG. 2. Secured to automated tightening mechanism 210 and projecting partially beyond the rear sole portion of shoe 110 is actuating wheel 212. By rolling actuating wheel 212 on the floor or ground, automated tightening mechanism 210 is rotated to a tightened position. Shoe lace 136 extends downwardly into chamber 200 from the two sides and passes through tightening mechanism 210 to tighten the shoe lace 136. Release lever 214 extends preferably from the rear upper of the shoe 110 to provide a convenient means for loosening the automated tightening mechanism, as described more fully herein.

Figure 7:
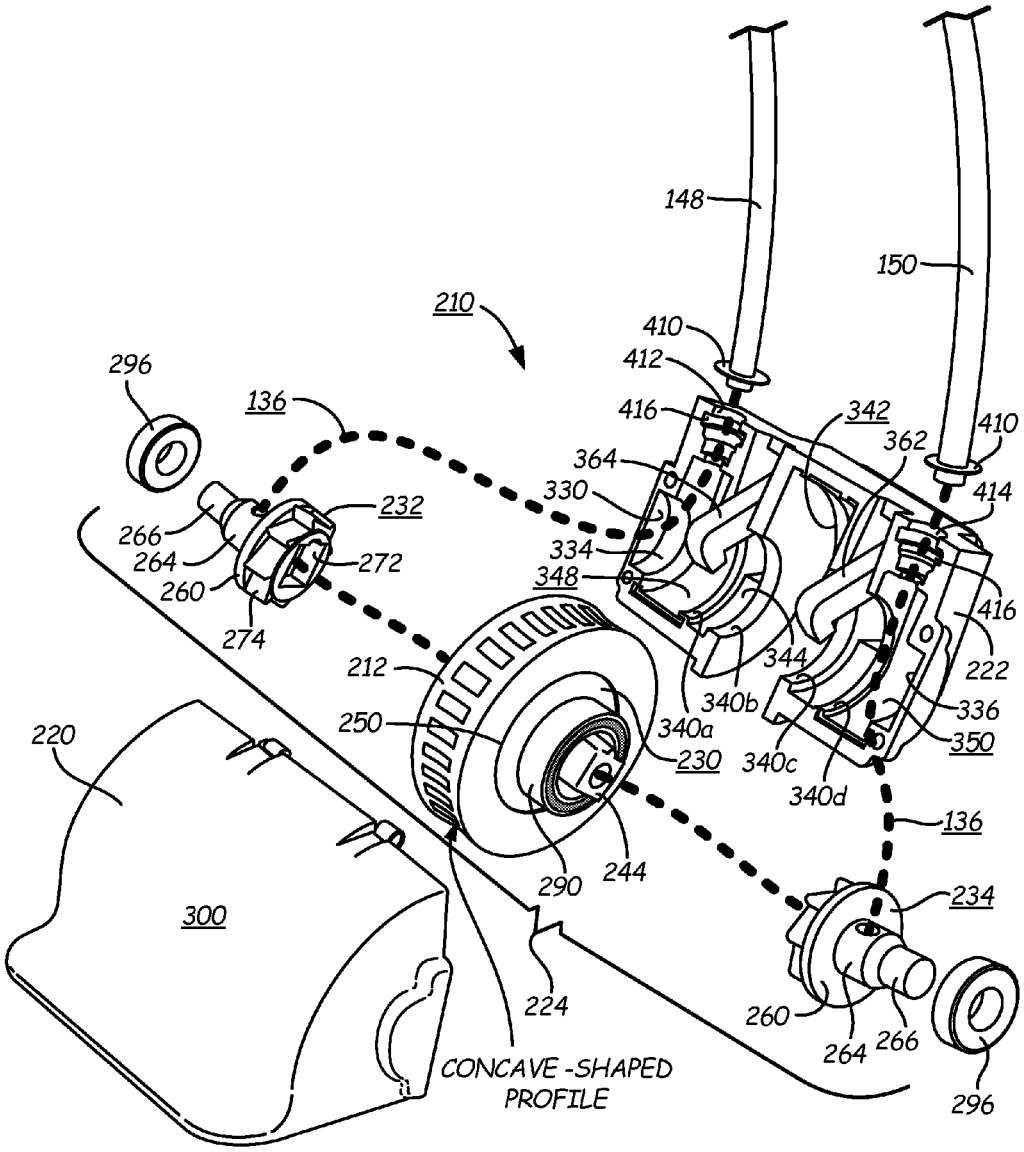
FIG. 7 illustrates an exploded perspective view of the parts of the automated tightening mechanism of the present invention.

The automated tightening mechanism 210 is shown in greater detail in FIG. 7. It comprises a forward case 220 and a rearward case 222, between which axle assembly 224 is secured. While screws may be used to fasten forward case 222 to rearward case 220, these two case portions may preferably be secured together by other means such as sonic welding or an adhesive. Release lever 214 is secured to rearward case 222, as disclosed herein. These case pieces may be made from any suitable material such as RTP301 polycarbonate glass fiber 10%. Another functionally equivalent material is nylon with 15% glass fiber.

Figure 8:
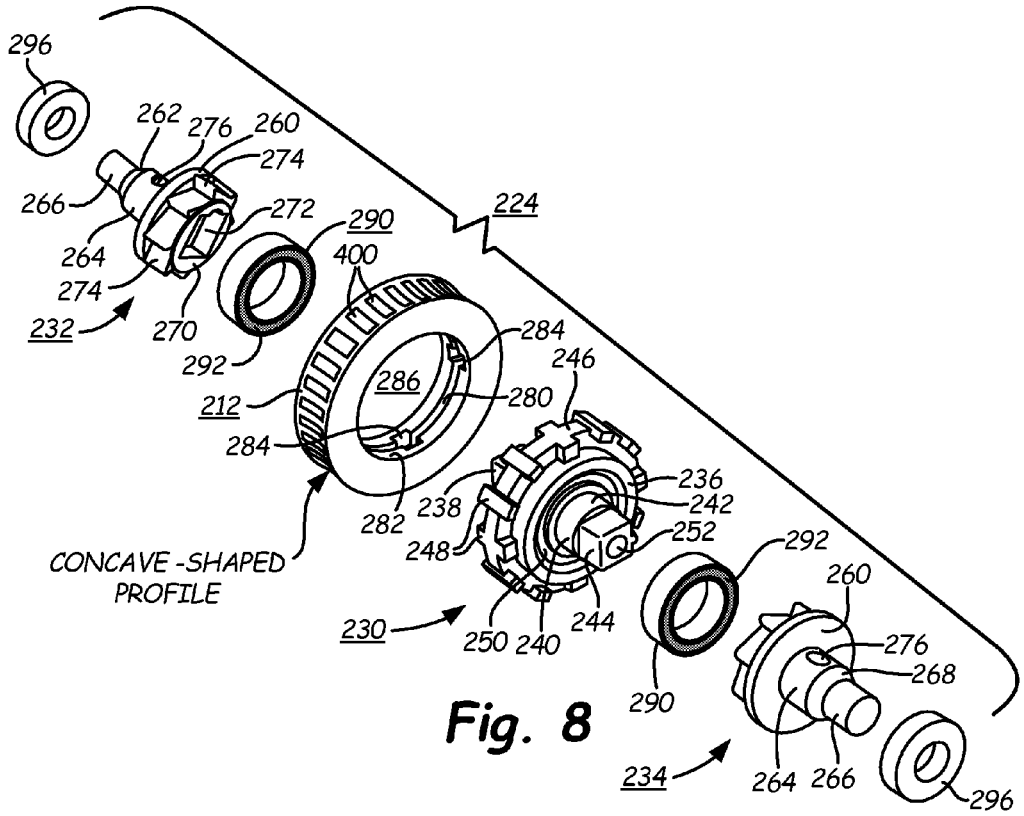
FIG. 8 illustrates an exploded perspective view of the parts of the axle assembly of the automated tightening mechanism.

The axle assembly 224 is shown more fully in exploded fashion in FIG. 8. It preferably comprises wheel shaft 230, first end shaft 232 and second end shaft 234. Each of these shaft portions are preferably molded from RTP 301 polycarbonate glass fiber 10% or functionally equivalent material. Other materials such as nylon may be used, but it is important that the wheel shaft portion 230, first end shaft 232 and second end shaft 234 feature properly dimensioned and configured surfaces that fit together to produce axle assembly 224 that rotates in unison, while providing the requisite strength for repetitive operation over time.

Focusing more closely upon wheel shaft 230, it comprises an integrally molded unit featuring a solid circular frame 236 having a first transverse axle 238 and second transverse axle 240 extending from its respective faces. Each transverse axle provides a cylindrical shoulder 242 and a cubic end cap 244 at its distal end. Molded along the cylindrical edge of solid circular frame 236 are continuous rib 246 and a plurality of cleats 248 extending laterally from the rib. Molded into the opposite faces of circular frame 236 is an annulus region 250 that surrounds transverse axle 240. Meanwhile, a bore 252 passes entirely through first transverse axle 238, circular frame 236, and second transverse axle 240, so that shoe lace 136 or engagement cable 196 can pass through this wheel shaft 230 portion of the axle assembly 224.

First end shaft 232 and second end shaft 234 are identical in their construction, and will be described together in conjunction with FIGS. 8 and 11. Disk 260 is connected on its outer face to axle 262. This axle 262 has inner cylindrical shoulder 264 and outer cylindrical boss 266 having a smaller diameter. Outer cylindrical boss 266 joins inner cylindrical shoulder 264 having a larger diameter to define bearing wall 268. Positioned on the opposite inside face of disk 260 is boss 270 having a square-shaped bore 272 with a plurality of ratchet teeth 274 extending from its exterior circumferential surface. Square bore 272 cooperates with hole 276 located on inner cylindrical shoulder 264 of axle 262 to produce a continuous passageway for passage of shoe lace 136 or engagement cable 196.

Figure 11:
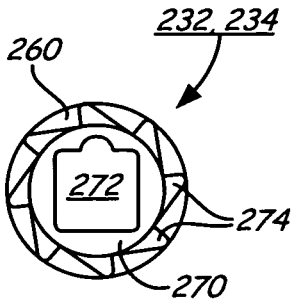
FIG. 11 illustrates an inner end view of the first end shaft or second end shaft portion of the axle assembly shown in FIG. 8.
Figure 12:
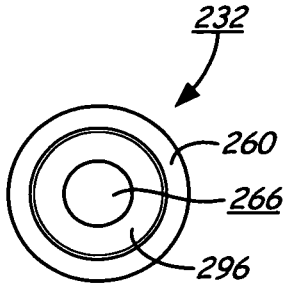
FIG. 12 illustrates an outer end view of the first end shaft or second end shaft shown in FIG. 8 having the bushing assembled thereto.
Figure 13:
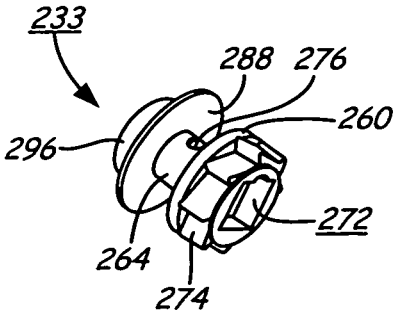
FIG. 13 illustrates a perspective view of the inner end of an alternative embodiment of the end shaft.
Figure 14:
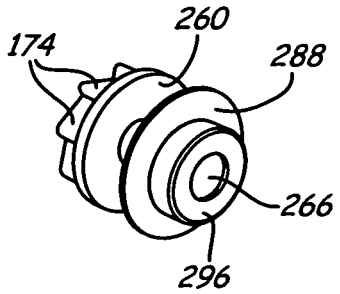
FIG. 14 illustrates a perspective view of the outer end of the alternative embodiment of the end shaft of FIG. 13.
Figure 15:
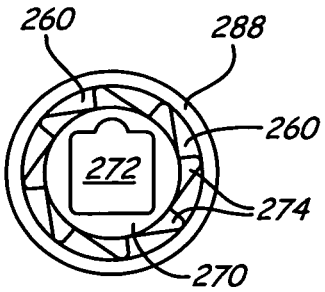
FIG. 15 illustrates an inner end view of the alternative embodiment of the end shaft of FIG. 13.
Figure 16:
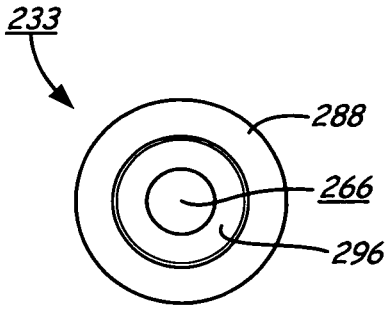
FIG. 16 illustrates an outer end view of the alternative embodiment of the end shaft of FIG. 13 having the bushing assembled thereto.

FIGS. 13-15 show an alternative embodiment 233 of first end shaft 232 or second end shaft 234. it is similar in design and construction to the end shaft depicted in FIGS. 7, 8, and 11 with the exception of an additional containment disk wall 288 molded between inner cylindrical shoulder 264 and outer cylindrical boss 266. This containment disk wall has a diameter that is larger than the diameter of the inner cylindrical shoulder. In this manner, containment disk wall 288 and disk portion 260 of end shaft 233 cooperate to define a region 289 for winding and unwinding lace 136 or engagement cable 196, while the containment disk wall 288 prevents undue lateral migration of the lace 136 or engagement cable 196. This helps to prevent the lace or engagement cable from getting tangled in the axle assembly 224, and impeding its rotational movement.

Figure 9:
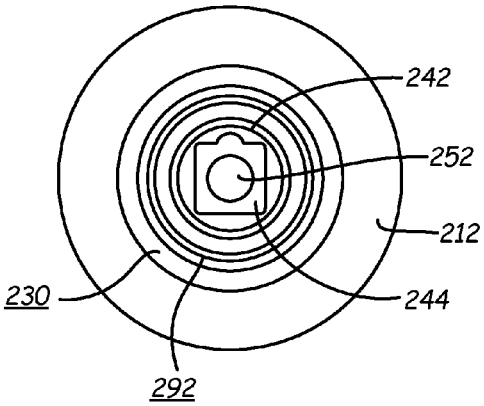
FIG. 9 illustrates a side view of the wheel shaft portion of the axle assembly with the actuator wheel assembled to it.

FIG. 9 shows actuator wheel 212 secured to wheel shaft 230. Actuator wheel 212, as shown more clearly in FIG. 8, contains a channel 280 running within its inner circumferential face 282. Located periodically along this channel 280 are a plurality of transverse recesses 284. The width and depth of channel 280 matches the width and height of rib 246 positioned along the outer circumferential surface of wheel shaft 230. Meanwhile, the width, length, and depth of transverse recesses 284 match the width, length and height of cleats 248 positioned along the outer-circumferential surface of wheel shaft 230. The diameter of the opening 286 of actuator wheel 212 is substantially similar to the diameter of rib 246 extending from circular frame 236 of wheel shaft 230. In this manner, actuator wheel 212 may be inserted around the periphery of circular frame 236 of wheel shaft 230 with rib 246 and cleats 248 cooperating with channel 280 and transverse recesses 284 so that the actuator wheel is secured to the wheel shaft.

Turning to FIG. 8 with actuator wheel 212 assembled to wheel shaft 230 (See FIG. 7), metal sealed bearings 290 are inserted around inner cylindrical shoulder 264 of wheel shaft 230 against bearing surface 292 (see FIG. 9) on circular frame 236. These metal sealed bearings 290 will support the axle assembly 224 inside frontward case 220 and rearward case 222 of the housing, while allowing the axle freedom to rotate. Towards this end, the inside diameter of the sealed bearings 290 should be slightly greater than the exterior diameter of inner cylindrical shoulder 264, so that the bearings may freely rotate.

At the same time, sealed bearings 290 contain a cylindrical rubber insert 292 fitted into an annular channel 293 formed within the sidewall of the bearing. This rubber insert helps to prevent dirt, grit, and other foreign debris from migrating past the bearing into the axle shaft assembly 224 where they can impede the proper rotation of actuator wheel 212. The bearing portion of sealed bearing 290 should be made from a strong material like stainless steel. Sealed bearings appropriate for the automated tightening mechanism 210 of this invention may be sourced from Zhejiang Fit Bearing Co. Ltd. of Taiwan.

Next, first end shaft 232 and second end shaft 234 will be assembled onto wheel shaft 230 with square recess 272 of the end shaft engaging the respective cubic end caps 244 of the wheel shaft 230. By using square recesses and cubic end caps, rotating wheel shaft 230 will necessarily transfer substantially all of its rotational force to the end shafts 232 and 234 without slippage.

Metal bushings 296 engage outer cylindrical boss 266 of end shafts 232 and 234 against bearing wall 268 or containment disk wall 288 of these two respective end shafts. The outside diameter 298 of these metal bushings should be sufficiently greater than the diameter of inner cylindrical shoulder 264 of the end shaft in order to define annular region 300 for wind up of shoe lace 136 within the end shaft embodiment 232, 234.

As shown more clearly in FIG. 7, shoe lace 136 passes from guide tube 148 through hole 276 and the interior passageway of end shaft 232, through the axle of wheel shaft 230, through the interior passageway and hole in end shaft 232, and back into guide tube 150. It may be easier to thread shoe lace 136 through these parts before they are fully assembled to form axle assembly 224.

Rolling actuator wheel 212 partially extending from the heel of shoe 110 will rotate wheel shaft 230, transverse axles 238 and 240, end shafts 232 and 234, and their respective bosses 270, and ratchet teeth 274 in a co-directional fashion. Actuator wheel 212 should be manufactured from shore 70 A urethane or functionally equivalent material. The wheel should preferably be one inch in diameter and have a 0.311 $in^3$ volume. Such a wheel size will be large enough to extend from the shoe heel, while fitting within housing 200 in the sole of shoe 110. Depending upon the size of the shoe and its end-use application, actuator wheel 212 could have a diameter range of ¼-1½ inches.

Figure 10:
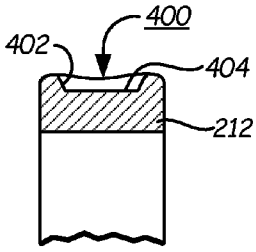
FIG. 10 illustrates a partial cutaway view of the actuator wheel showing one of the treads formed within the exterior surface of the wheel.

In a preferred embodiment, actuator wheel 212 can have a plurality of tread depressions 400 formed transversely within the exterior surface of the wheel, as shown in FIG. 8. These treads will provide traction as the wheel 212 is rotated to tighten the shoe around the user's foot. Ideally, such treads 400 will have side walls 402 that are outwardly flared with respect to bottom wall 404 to reduce the likelihood of small stones and other debris getting lodged inside the treads (see FIG. 10).

Figure 17:
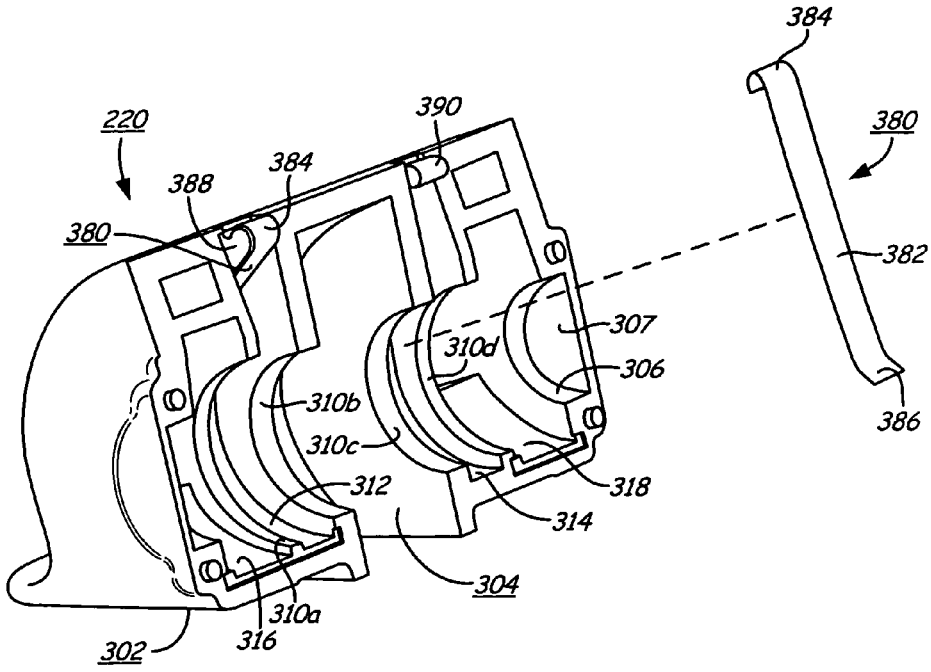
FIG. 17 illustrates a perspective interior view of the forward housing case of the automated tightening mechanism with one of the leaf springs assembled within the forward case and the other leaf spring removed.

Forward case 220 as shown in FIGS. 7 and 17 is preferably molded from RTP 301 polycarbonate glass fiber 10% or functionally equivalent material. It has an outer surface wall 300 and base wall 302. This base wall 302 should be flat so that it provides an ideal way to fasten the housing assembly 220 and 222 containing the automated tightening mechanism 210 to the chamber bottom 202, such as by means of adhesive. This housing contains the various parts of the automated tightening mechanism while allowing entry and exit of the shoe lace 136, rotation of the axle assembly 224 in both the tightening and loosening direction, and external operation of the actuator wheel 212 and release lever 214 extending therefrom.

FIG. 17 shows the interior of forward case 220. It features cut-away portion 304 for accommodating actuator wheel 212. Actuator wheel 212 must be capable of rotating freely without rubbing against forward case 220. Shoulder surfaces 306 and 308 defined by indents 307 and 309 provide a bearing surface for bushings 296 that surround the outer cylindrical bosses 266 of first end shaft 232 and second end shaft 234 or end shaft 233, thereby defining the ends of axle assembly 224. Shoulders 310*a*, 310*b*, 310*c*, and 310*d* provide additional means of support for the disks 260 and sealed bearings 290 on first end shaft 232 and second end shaft 234 portions of axle assembly 224. Wells 312 and 314 in forward case 220 accommodate bosses 270 and their ratchet teeth 274 on each end shaft. Finally, wells 316 and 318 accommodate shoe lace 136 as it is wound around the inner cylindrical shoulder portions 232 and 234 of axle assembly 224.

Figure 18:
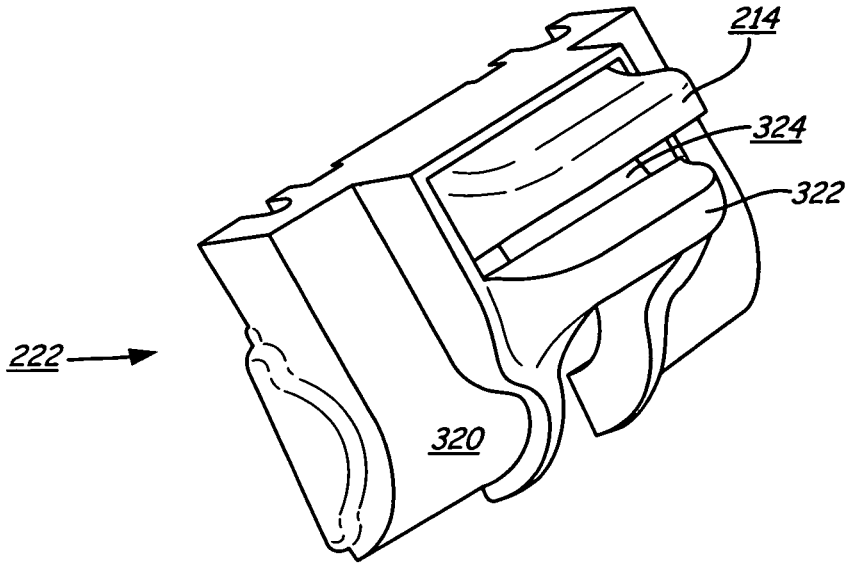
FIG. 18 illustrates a perspective exterior view of the rearward housing case of the automated tightening mechanism with the release lever assembled.
Figure 19:
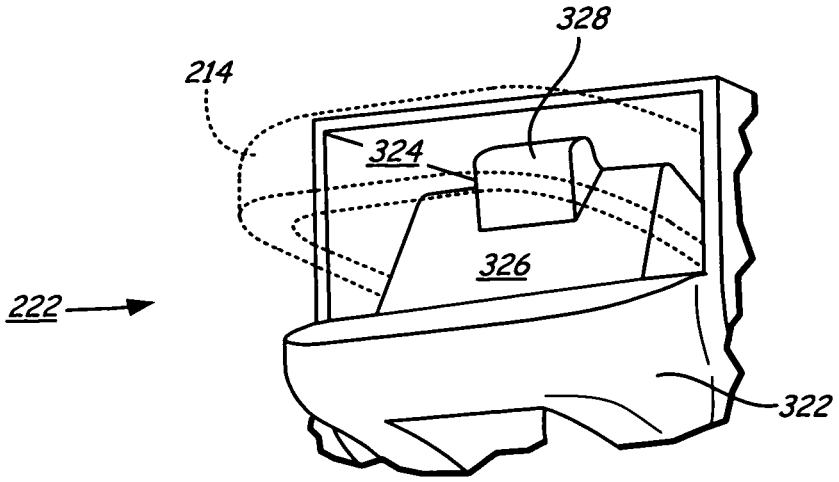
FIG. 19 illustrates a perspective exterior view of the rearward housing case shown in FIG. 7 with the release lever shown in phantom line.

The exterior of rearward case 222 is shown in FIGS. 18 and 19. Extending from exterior surface 320 in molded fashion is base support 322 for the release lever 214 when it is in its standby position. This release lever extends through window 324. Extending inwardly from base support 322 into window 324 is ramp 326 with flange 328 positioned on its top surface.

Turning to FIG. 7 which shows the interior of rearward case 222, one can perceive indents 330 and 332 which secure outside bushings 296 positioned on the ends of axle assembly 224. These bushings are supported by shoulders 334 and 336. The axle assembly 224 in turn is supported by shoulders 340*a*, 340*b*, 340*c*, and 340*d*. Cut-away region 342 accommodates actuator wheel 212. Wells 344 and 346 accommodate ratchet wheels 270. Wells 348 and 350 accommodate shoe lace 136 as it is wound around inner cylindrical shoulders 264 of the axle assembly 224.

Figure 20:
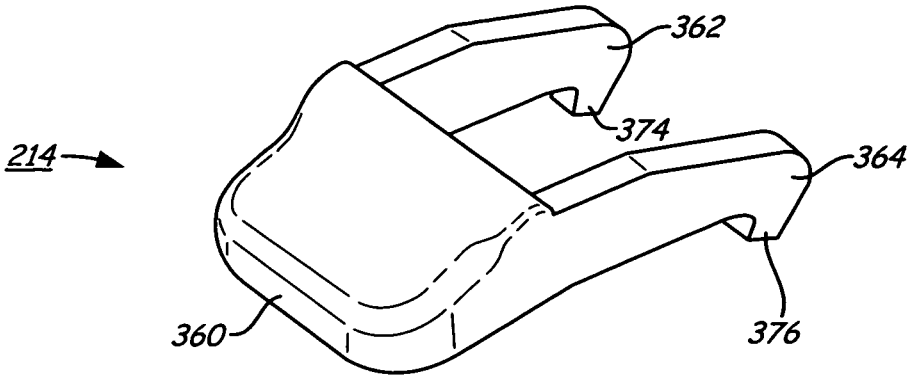
FIG. 20 illustrates a perspective view of the release lever of the automated tightening mechanism.
Figure 21:
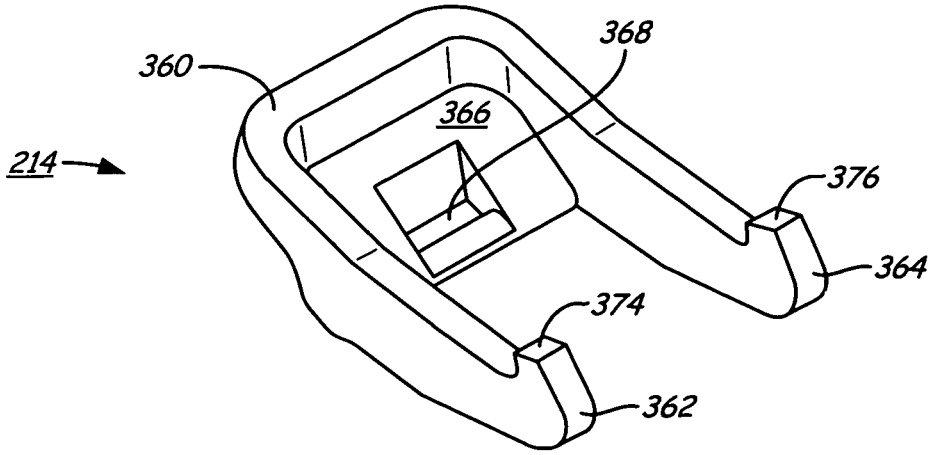
FIG. 21 illustrates an upside-down, perspective view of the release lever of FIG. 20.

Release lever 214 is shown in greater detail in FIGS. 20-21. It is preferably molded from RTP 301 polycarbonate glass fiber 10% or functionally equivalent material. It comprises a lever 360 at one end and two arms 362 and 364 at the other end. Located along interior surface 366 is indent 368.

Release lever 214 is mounted into pivotable engagement with rearward case 222 with flange 328 of rearward case 222 engaging indent 368 in release lever 214. The cooperating dimensions and shapes of this flange and recess are such that the release lever can be pivoted between its standby and released positions, as described further below. Meanwhile, arms 362 and 364 extend down through holes 370 and 372 in the rearward case, so that the pawl ends 374 and 376 of release lever arms 362 and 364 may abut teeth 274 the first end shaft 232 and second end shaft 234 of the axle assembly 224.

Instead of the release lever depicted in this application, any other release mechanism that disengages the pawl from the ratchet wheel teeth may be used. Possible alternative embodiments include without limitation a push button, pull chord, or pull tab.

Two leaf springs 380 made from stainless steel metal are used to bias the release lever 214 into its standby position. As shown more fully in FIG. 17, they comprise a middle bearing surface 382, a lipped end 384, and flared end 386. The leaf springs 380 are inserted into wells 312 and 314 with lipped end 384 hooked around flanges 388 and 390 on forward case 220. Meanwhile, flared end 386 of each leaf spring rests on the lower surface of wells 312 and 314. When end 360 of release lever 214 is pushed down by the user to bias the release lever to its released position, pawls 374 and 376 will touch the leaf springs 380 to push them inwardly towards the curved walls of wells 312 and 314. The natural flex in the leaf springs will then push the pawls away to return them into engagement once again with the ratchet teeth 274 when the release lever is no longer pushed down. Alternatively, a compression spring or torsion spring may be employed to bias the release lever pawls into engagement with the ratchet wheel teeth of the automated tightening mechanism. Such stainless steel leaf springs 380 may be sourced from KY-Metals Company of Taipei, Taiwan. They may alternatively be formed from a polycarbonate material having sufficient flex.

The guide tubes 149 and 150 containing the lace 136 or engagement cable 196 need to be secured to rearward case 222 so that they do not become detached. In the embodiment shown in FIG. 7, the guide tubes bear flat washers 410 near their end. The end of each guide tube 148, 150 is inserted inside an inlet portal channel 412, 414 formed within the top wall of the rearward case 222. Washer 410 fits inside annular recess 416 formed within the portal channel wall 412, 414 to prevent the guide tube 148, 150 from being pulled away from the rearward case 222 when it is assembled to forward case 220. Alternatively, the portal channel wall 414, 416 can feature a series of serrated teeth 418 formed along its interior wall surface. In this manner, the guide tube can be pushed into fixed engagement inside the portal channel 412, 414 without the need for washer 410 and recess 416.

In operation, the wearer will position his foot so that actuator wheel 212 extending from the rear of the shoe sole 120 of the automated tightening shoe 110 abuts the floor or ground. By rolling the heel of the shoe away from his body, actuator wheel 212 will rotate in the counterclockwise direction. Wheel shaft assembly 230 and associated end shafts 232 and 234 will likewise rotate in the counterclockwise direction, thereby winding shoe lace 136 around inner cylindrical shoulders 264 of the axle assembly within the housing of the automated tightening mechanism. In doing so, lace 136 will tighten within shoe 110 around the wearer's foot without use of the wearer's hands. Pawl ends 374 and 376 of the release lever 214 will successively engage each tooth 274 of ratchet wheels 270 to prevent clockwise rotation of the ratchet wheels that would otherwise allow the axle assembly to rotate to loosen the shoe lace. Leaf spring 380 bears against the pawl ends to bias them into engagement with the ratchet wheel teeth.

If the wearer wants to loosen the shoe lace 136 to take off shoe 110, he merely needs to push down release lever 214, which extends preferably from the rear sole of the shoe. This overcomes the bias of leaf springs 380 to cause pawl ends 374 and 376 to disengage from the teeth 274 of ratchet wheels 270, as described above. As axle assembly 224 rotates in the clockwise direction, the shoes lace 136 will naturally loosen. The wearer can push down the release lever with his other foot, so that hands are not required for engaging the release lever to loosen the shoe.

The automated tightening mechanism 210 of the present invention is simpler in design than other devices known within the industry. Thus, there are fewer parts to assemble during shoe manufacture and to break down during usage of the shoe. Another substantial advantage of the automated tightening mechanism embodiment 210 of the present invention is that shoe lace 136 and their associated guide tubes may be threaded down the heel portion of the shoe upper, instead of diagonally through the medial and lateral uppers. This feature greatly simplifies manufacture of shoe 110. Moreover, by locating automated tightening mechanism 210 closer to the heel within shoe sole 120, a smaller housing chamber 200 may be used, and the unit may more easily be inserted and glued into a smaller recess within the shoe sole during manufacture.

Another significant advantage of the automated tightening mechanism 210 of the present invention is the fact that a single shoe lace 136 is used to tighten the shoe, instead of two shoe laces or shoe laces connected to one or more engagement cables which in turn are connected to the tightening mechanism. By passing the shoe lace through the axle assembly 224, instead of fastening the shoe lace ends to the axle assembly ends, replacement of a worn or broken shoe lace is simple and straight-forward. The ends of the shoe lace 136 may be removed from clip 138 along lacing pad 114 and untied. A new lace may then be secured to one end of the old lace. The other end of the old lace may then be pulled away from the shoe in order to advance the new shoe lace into the shoe, through guide tube 148, through the axle assembly 224, through the other guide tube 150, and out of the shoe. Once this is done, the two ends of the new shoe lace can then be easily threaded through the shoe eyelets located along the lacing pad 114, tied together, and secured once again under the clip 138. In this manner, the shoe lace can be replaced without physical access to the automated tightening mechanism 210 that is concealed inside the housing inside the chamber within the sole of the shoe. Otherwise, the should would need to be dismantled to provide access to the tightening mechanism to rethread the new shoe lace.

Another advantage provided by the automated tightening mechanism 210 of the present invention is that the ends of the shoe lace 136 are not tied to the ends of the axle assembly 224. Thus, the shoe lace ends will not cause the shoe lace to bind as it is wound or unwound around the axle ends. If the shoe lace ends were to be tied to the axle ends with a knot, then a recess would have to be provided within each axle end to accommodate these knots. These recesses might weaken the axle assembly 224 due to reduced material stock within the axle ends.

The outside bushings 296 positioned along the axle assembly ends provide support means for the axle assembly 224, while allowing it to rotate within the housing. But, the increased diameter of these outside bushings compared with the diameter of the cylindrical shoulders 264 of the axle assembly allow a lace wind-up zone to be defined along the cylindrical shoulders between the collars 296 and disks 260. The bushings help to prevent lateral migration of the shoe lace as it is wound or unwound around the axle assembly.

The two sealed metal bearings 290 positioned along the axle assembly provide support for the axle assembly within the housing. However, they also allow the axle assembly to rotate as the metal bearings freely rotate. Moreover, the rubber seals along the side walls of the bearings act to keep dirt, grit, and grime out of the automated tightening mechanism 210. Sealed bearings are not generally used in shoe products.

By making actuator wheel 212 separate from wheel shaft 230, it can be easily replaced. The actuator wheel may also be made from a different material than the material used for the wheel shaft for improved performance.

The exterior surface of actuator wheel 212 is preferably provided with a concaved profile. This surface configuration will act to keep dirt, grit, and grime from entering the housing of the automated tightening mechanism 210 that might otherwise cause the actuator wheel to stick. this concaved surface has been found to actually spin dirt and mud away from entry into the housing.

Wheel actuator 212 may be any size in diameter as long as it can extend from the shoe sole without interfering with the normal walking or running usage of the shoe. At the same time, it must fit within the housing for the automated tightening mechanism. It should be ¼-1½ inches in diameter, preferably one inch in diameter. It may be made from any resilient and durable material like urethane rubber, synthetic rubber, or a polymeric rubber-like material.

The shoe lace 136 of the present invention may be made from any appropriate material, including but not limited to Spectra® fiber, Kevlar®, nylon, polyester, or wire. It should preferably be made from a Spectra core with a polyester exterior weave. Ideally, the shoe lace will have a tapered profile for ease of transport within tubes 148 and 150. The strength of the lace can fall within a 200-1000 pound test weight.

Tubes 148 and 150 may be made from any appropriate material, including but not limited to nylon or Teflon®. They should be durable to protect the engagement cables or laces, while exhibiting self-lubricating properties in order to reduce friction as the engagement cable or lace passes through the tube during operation of the automated tightening mechanism.

The above specification and drawings provide a complete description of the structure and operation of the automated tightening mechanism and shoe of the present invention. However, the invention is capable of use in various other combinations, modifications, embodiments, and environments without departing from the spirit and scope of the invention. For example, the shoe lace or engagement cable may be routed along the exterior of the shoe upper, instead of inside the shoe upper between the inside and outside layers of material. Moreover, the automated tightening mechanism may be located in a different position within the sole besides the rear end, such as a mid point or toe. In fact, the automated tightening mechanism may be secured to the exterior of the shoe, instead of within the sole. Multiple actuating wheels may also be used to drive a common axle of the automated tightening mechanism. While the actuator has been described as a wheel, it could adopt any of a number of other possible shapes, provided that they can be rolled along a flat surface. Finally, the shoe need not use eyelets along the lacing pad. Other known mechanisms for containing the shoe lace in a sliding fashion, such as hooks or exterior-mounted eyelet place. Therefore, the description is not intended to limit the invention to the particular form disclosed.

I claim:

1. An automated tightening shoe, comprising:

(a) a shoe having a sole and an upper connected to the sole, the upper including a toe, a heel, a medial side portion, and a lateral side portion;

(b) a single shoe lace or cable connected to an exterior surface of the medial and lateral side portions of the upper for drawing the medial and lateral side portions around a foot placed inside the shoe;

(c) a tightening mechanism secured to the shoe, the tightening mechanism including: an axle having two ends, a cylindrical side surface, and a continuous passageway therethrough with two exit apertures along the side surface; at least one ratchet wheel having a plurality of teeth, such ratchet wheel attached to the axle of the tightening mechanism in a fixed relationship; and an actuator wheel rigidly connected to the axle and extending outside the shoe;

(d) the shoe lace or cable being passed through the continuous passageway and two exit apertures formed within the axle, through or along the medial and lateral side uppers with the free ends of the shoe lace or cable secured together and attached to the exterior point on the shoe, so that the shoe lace or cable forms a continuous loop;

(e) whereby rotation of the actuator wheel extending outside the shoe against the ground or another hard surface causes rotation of the axle of the tightening mechanism to draw the shoe lace or cable around the axle in a tightening direction to draw the medial and lateral side upper portions around the foot, pawl mechanism operatively engaging a tooth along the at least one ratchet wheel of the tightening mechanism acting to impede counter-rotation of the axle to prevent the shoe lace or cable from loosening; and (f) a release mechanism operatively connected to the pawl mechanism for selective disengagement of the pawl mechanism from the ratchet wheel tooth to enable counter-rotation of the axle to allow the medial and lateral uppers to loosen.

2. The automated tightening shoe of claim 1 further comprising a plurality of guide means spaced along and connected to the edge of the medial and lateral side uppers, wherein the single shoe lace or cable extends through alternate ones of the guide means in a crisscross or zig-zag fashion for drawing the medial and lateral side uppers around a foot placed inside the shoe.

3. The automated tightening shoe of claim 2, wherein the guide means comprises at least one lace eyelet.

4. The automated tightening shoe of claim 2, wherein the guide means comprises at least one hook.

5. The automated tightening shoe of claim 1 further comprising a closure panel overlaying the medial and lateral side uppers of the shoe wherein the single shoe lace or cable draws the closure panel around the medial and lateral side uppers to draw the medial and lateral side uppers around a foot placed inside the shoe.

6. The automated tightening shoe of claim 1, further comprising a chamber in the sole for containing the tightening mechanism.

7. The automated tightening shoe of claim 6, wherein the chamber is located closely adjacent to the heel of the shoe.

8. The automated tightening shoe of claim 1, wherein the tightening mechanism is attached to the exterior of the shoe.

9. The automated tightening shoe of claim 1 further comprising bias means for forcing the release means into engagement with the securement means.

10. The automated tightening shoe of claim 9, wherein the bias means comprises a compression spring or torsion spring.

11. The automated tightening shoe of claim 9, wherein the bias means comprises a leaf spring.

12. The automated tightening shoe of claim 1 further comprising a housing surrounding the tightening mechanism.

13. The automated tightening shoe of claim 1 further comprising at least one sealable bearing positioned along the axle for reducing passage of dirt or other foreign material into the tightening mechanism.

14. The automated tightening shoe of claim 1, further comprising a concave-shaped profile along the actuator wheel surface that comes into contact with the ground or other hard surface for reducing passage of dirt or other foreign material into the tightening mechanism.

15. The automated tightening shoe of claim 1 further comprising at least one tread formed within the exterior surface of the actuator wheel for providing added traction to the actuator wheel when it is rotated by the user against the ground or other hard surface.

16. The automated tightening shoe of claim 1, wherein the release mechanism comprises a pivotable lever.

17. The automated tightening shoe of claim 1, wherein the release mechanism comprises a push button.

18. The automated tightening shoe of claim 1, wherein the release mechanism comprises a pull loop.

19. The automated tightening shoe of claim 1 further comprising a clip for attaching the shoe lace or cable at a point along its continuous loop to the exterior surface of the shoe.

20. The automated tightening shoe of claim 1, wherein the shoe comprises an athletic shoe.

21. The automated tightening shoe of claim 1, wherein the shoe comprises a hiking shoe.

22. The automated tightening shoe of claim 1, wherein the shoe comprises a boot.

23. The automated tightening shoe of claim 1, wherein the shoe comprises a recreational shoe.

24. The automated tightening shoe of claim 1 further comprising at least one guide tube located within the shoe upper for containing the shoe lace or engagement cable.

* * * * *